US006550763B2

(12) United States Patent
Gordon et al.

(10) Patent No.: US 6,550,763 B2
(45) Date of Patent: Apr. 22, 2003

(54) FINISHER WITH SHEET PLACEMENT CONTROL

(75) Inventors: Michael Kurt Gordon, Lexington, KY (US); William Joseph Thornhill, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 201 days.

(21) Appl. No.: 09/774,852

(22) Filed: Jan. 31, 2001

(65) Prior Publication Data

US 2002/0101030 A1 Aug. 1, 2002

(51) Int. Cl.[7] ..... B65H 29/34

(52) U.S. Cl. ..... 271/189; 271/192; 271/209; 271/213

(58) Field of Search ..... 271/189, 207, 271/209, 192, 213

(56) References Cited

U.S. PATENT DOCUMENTS

| | | | | |
|---|---|---|---|---|
| 1,217,650 A | | 2/1917 | Snyder | |
| 3,669,447 A | | 6/1972 | Turner et al. | |
| 3,847,388 A | | 11/1974 | Lynch | |
| 3,970,299 A | | 7/1976 | Berger, Jr. et al. | |
| 4,049,256 A | | 9/1977 | Church et al. | |
| 4,060,237 A | | 11/1977 | Degen et al. | |
| 4,083,552 A | * | 4/1978 | Sioman | 271/189 |
| 4,257,587 A | | 3/1981 | Smith | |
| 4,265,444 A | * | 5/1981 | Berglund | 271/207 |
| 4,269,401 A | * | 5/1981 | Sargis et al. | 270/58.18 |
| 4,319,743 A | | 3/1982 | Rood | |
| 4,379,549 A | | 4/1983 | Mizuma | |
| 4,548,399 A | | 10/1985 | Heider et al. | |
| 4,844,633 A | * | 7/1989 | Greenberg | 101/419 |
| 4,898,374 A | | 2/1990 | Vermaat | |
| 4,925,172 A | | 5/1990 | Christy et al. | |
| 4,997,176 A | * | 3/1991 | Hain | 109/24.1 |
| 5,013,021 A | | 5/1991 | Johdai et al. | |
| 5,021,837 A | | 6/1991 | Uto et al. | |
| 5,037,077 A | | 8/1991 | Kubota et al. | |
| 5,120,046 A | | 6/1992 | Mandel et al. | |
| 5,131,644 A | | 7/1992 | DuBois | |
| 5,201,515 A | | 4/1993 | Funk | |
| 5,288,062 A | | 2/1994 | Rizzolo et al. | |
| 5,435,535 A | | 7/1995 | Suzuki et al. | |
| 5,451,044 A | * | 9/1995 | Nakayama | 271/189 |
| 5,473,420 A | | 12/1995 | Rizzolo et al. | |
| 5,516,091 A | * | 5/1996 | Nakayama | 271/182 |
| 5,580,041 A | * | 12/1996 | Nakayama | 271/189 |
| 5,791,644 A | | 8/1998 | Regimbal et al. | |
| 6,092,948 A | * | 7/2000 | Altfather | 271/189 |
| 6,142,466 A | | 11/2000 | Dickhoff | |
| 6,181,908 B1 | * | 1/2001 | Leemhuis et al. | 271/188 |

FOREIGN PATENT DOCUMENTS

| | | | |
|---|---|---|---|
| JP | 7-53111 | * | 2/1995 |
| JP | 8-26558 | * | 1/1996 |

* cited by examiner

*Primary Examiner*—Patrick H. Mackey
(74) *Attorney, Agent, or Firm*—John A. Brady

(57) ABSTRACT

Sheets (57) exit printer (1) into finisher (3) through corrugation rollers (13*a*–13*d*, 15*a*, 15*b*, 15*aa*, 15*bb*) encounter actuator tab (9*a*) to thereby rotate actuator (9) upward. Bails (11*a*–11*b*) are engaged by this and rotate upward. Each bail has a wing (11*d*, 11*dd*, 11*e*), which prevents curling. When the sheet is exited, gravity acting on the sheet and the actuator tab causes the sheet to drop. The bails also drop under gravity. The sheet is positioned to drop flat and near the exit, as intended for the finisher to form stacks of sheets.

24 Claims, 16 Drawing Sheets

FINISHER WITH SHEET PLACEMENT CONTROL

RELATED APPLICATIONS

U.S. patent application Ser. No. 09/773,360 filed on even date herewith, is directed to coverage for the sheet placement control of the apparatus described herein. Similarly, U.S. patent application Ser. No. 09/611,126, filed Jul. 6, 2000, is directed to the curl control mechanism.

TECHNICAL FIELD

This invention relates to the accumulation of sheets exiting a printer into a neat stack and then binding the sheets, as by stapling. Apparatus to achieve such function is commonly known as a finisher.

BACKGROUND OF THE INVENTION

Described herein is an apparatus which receives sheets on a tray and moves the sheets laterally against reference surfaces so as to form a neat stack, which is then stapled or otherwise bound. Because paper and similar sheets buckle and then can move from the forces stored in the buckled sheet, apparatus alternative to that described herein can be cumbersome or unreliable.

The apparatus described herein requires paper or other sheets to fall in a controlled manner on to a tray, such sheets are being fed from a set of rollers and tend to curl forward, which results in the paper not falling flat or not reaching the intended area generally directly under the sheet when fed flat. In accordance with this invention, a mechanism is provided to hold each sheet generally over the tray until the back end of the paper is free, at which point the mechanism frees the sheet to drop downward.

DISCLOSURE OF THE INVENTION

In accordance with this invention a pivoted actuator member is positioned to intersect a printed sheet as it moves out of the printer. The sheet rotates the actuator member. The actuator member has extensions which engage extensions of pivoted bails located on each side of the sheet path. This pivots the bails upward. Each bail has an extended surface, which becomes positioned under the sheet. The sheet is thereby held against curling while the sheet is being exited.

When the sheet has exited and is free, gravity acting on the sheet and the actuator cause the sheet to drop. The bails also drop under gravity.

The sheet is positioned to drop flat and near the exit, as intended for the finisher to form stacks of the sheets.

BRIEF DESCRIPTION OF THE DRAWINGS

The details of this invention will be described in connection with the accompanying drawings in which.

DESCRIPTION OF THE EMBODIMENTS

Figure 1:
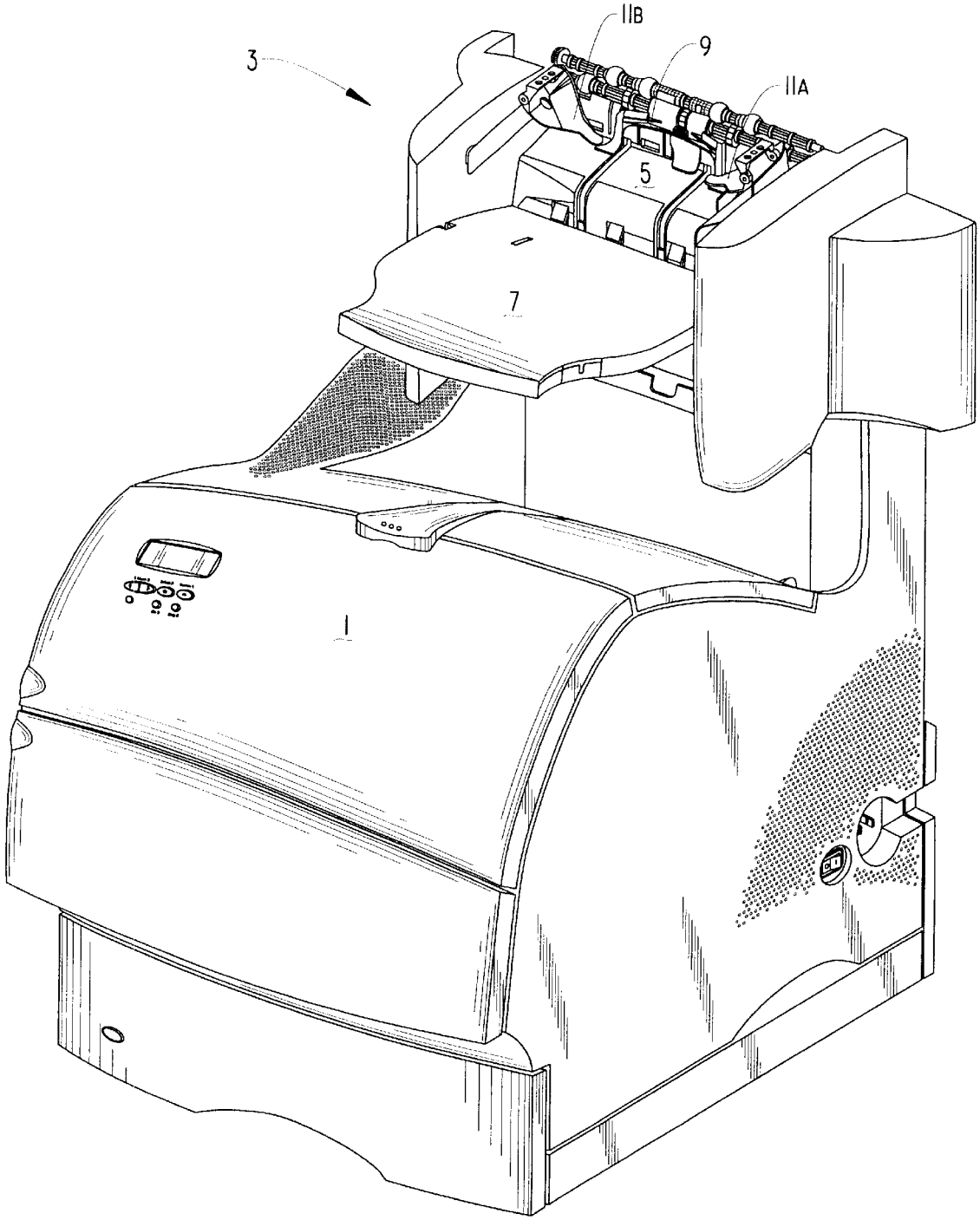
FIG. 1 is an overview of a combined printer and finisher.

FIG. 1 shows a printer 1 and finisher 3 combination in accordance with this invention. Finisher 3 can be detachable from printer 1. While attached, printed sheets are fed from the rear of printer 1 vertically into the rear of finisher 3, which may be in a known manner such as described in detail in U.S. Pat. No. 5,810,353 to Baskette et al. Similarly, printer 1 may be a laser printer such as those widely sold under the trademark OPTRA by the assignee of this invention or as modified in the future.

FIG. 1 shows the stacking tray 5 of finisher 3 in which printer sheets are initially dropped, then moved to be stapled and ejected into output tray 7. Output tray 7 is spring mounted so that the tray moves downward as sheets are placed on it to maintain a vertical separation between stacking tray 5 and output tray 7. Also shown in FIG. 1 is the bail actuator 9, the right bail 11*a,* and the left bail 11*b,* which functions to support printed sheets while exiting finisher 3 as will be described.

Figure 2:
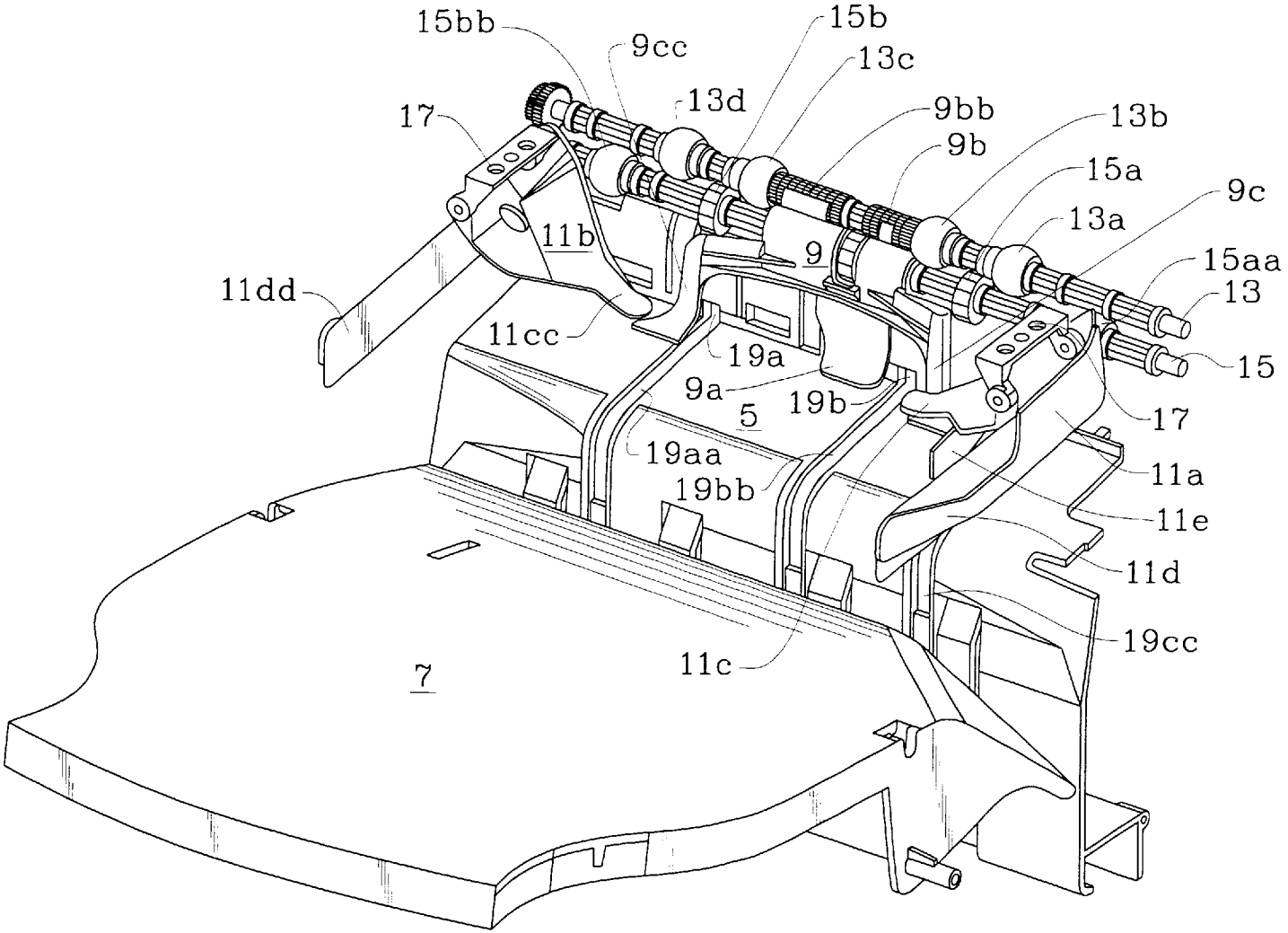
FIG. 2 is a view from the upper right of the major elements of the finisher.

FIG. 2 is a view from the upper right showing major elements of finisher 3. Near the rear are upper corrugation roller shaft 13, carrying four, spaced corrugation rollers 13*a,* 13*b,* 13*c* and 13*d.* Immediately below corrugation roller shaft 13 is lower corrugation roller shaft 15 carrying narrow corrugation roller 15*a,* located between upper rollers 13*a* and 13*b,* and narrow corrugation roller 15*b,* located between upper rollers 13*c* and 13*d.* Additionally, shaft 15 carries wide corrugation roller 15*aa* located past upper roller 13*a* toward the right side of shaft 15, and shaft 15 carries wide corrugation roller 15*bb* located past upper roller 13*d* toward the left side of shaft 15.

The corrugation rollers 13*a*–13*d* and 15*a,* 15*b,* 15*aa* and 15*bb* function in a known manner to induce wave shapes across paper or other sheets exiting rollers 13 and 15 into stacking tray 5. These waves or corrugations add stiffness or beam strength to the paper. To accommodate the desirability for the depth of the corrugation to be greater for light-weight papers, one or both of shafts 13 and 15 may be flexible or spring mounted. Such variable corrugation is previously known.

Even with such corrugation, however, the end of the sheets may curl downward toward tray 7 and therefore not fall flat as desired. Bails 11*a* and 11*b* are introduced to assure that sheets fall flat. Bail actuator 9 has a depending tab 9*a* which fed sheets encounter. Actuator 9 has circular extensions 9*b* and 9*bb,* which are mounted around shaft 13. On each side of actuator 9 are arms 9*c* and 9*cc.*

As shown in FIG. 2, actuator 9 is in the rest position caused by pivoting around extensions 9*b* and 9*bb* under the influence of gravity. Actuator arms 9*c* and 9*cc* are at a low position. However, when paper as light as 16 pound paper or a similar sheet is fed through corrugation rollers 13, 15 the sheet encounters tab 9*a* and pushes tab 9*a* so that actuator 9 is pivoted upward by extension 9*b* and 9*bb* rotating around shaft 13.

Right bail 11*a* and left bail 11*b* are on opposite sides of actuator 9 and are freely pivoted to frame 17. Each has an actuation arm 11*c,* 11*cc* respectively, which extends over actuator arm 9*c,* 9*cc* respectively. Right bail 11*a* has a long wing 11*d* extending outward toward tray 7 and a second wing 11*e* shorter than wing 11*d,* spaced inward from wing 11*d,* and also extending outward toward tray 7. Left bail 11*b* has a single long wing 11*dd* extending outward toward tray 7.

In operation, each sheet exiting shafts 13 and 15 encounters tab 9*a* and pushes tab 9*a* upward, thereby rotating actuator tab 9 upward around extensions 9*b,* 9*bb.* During such rotation actuator arms 9*c,* 9*cc* encounter actuation arms 11*c,* 11*cc* respectively and continue to move to thereby pivot bails 11*a* and 11*b* upward. In this upward position, long wings 11*d* and 11*dd* are located under sheets of standard width to support opposite sides and prevent the sheets from curling downward. Similarly, long wing 11*dd* and shorter wing 11*e* support narrow sheets. (Since in this particular implementation sheets are registered to the left as shown in FIGS. 1 and 2, only one short wing located on the right is needed.)

As soon as the pushing force on a sheet ends by the sheet exiting over trays 5 and 7, gravity again controls actuator 9, which rotates downward. Similarly bails 11*a* and 11*b* are no longer supported by actuator 9, and bails 11*a* and 11*b* rotate downward by gravity. Tab 9*a* also pushes the sheet down. The sheet goes on to trays 5 and 7.

Tab 9*a* also acts beneficially as a drag force on the exiting sheet against forward movement as it exits. This insures paper placement near the rear of finisher 3.

Also shown in FIG. 2 are set pusher tabs 19*a* and 19*b* (19*c* being obscured) on endless bands 19*aa,* 19*bb* 19*cc.*

Figure 3:
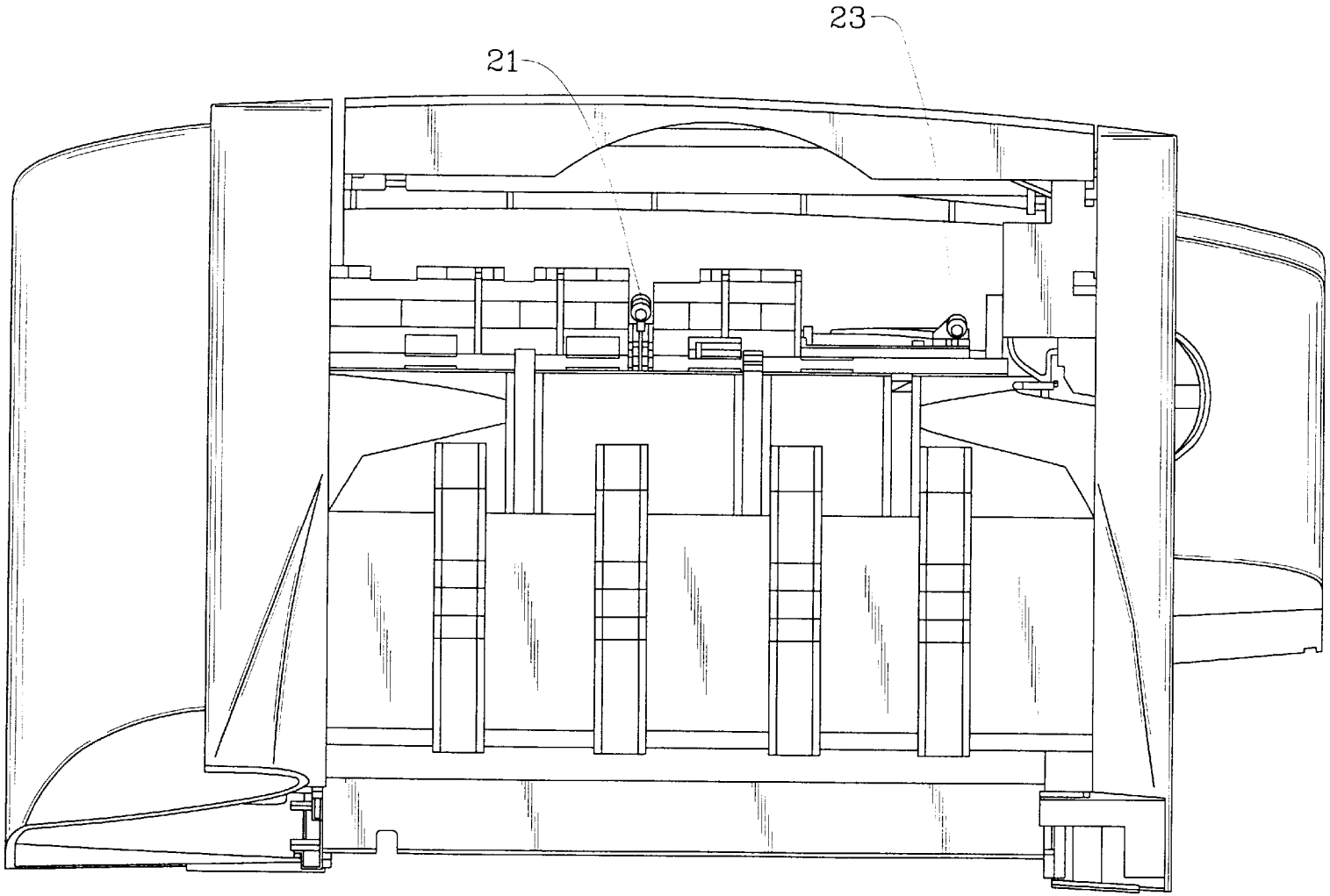
FIG. 3 illustrates the two frictional fingers located for a printed sheet to fall on the tray.
Figure 4:
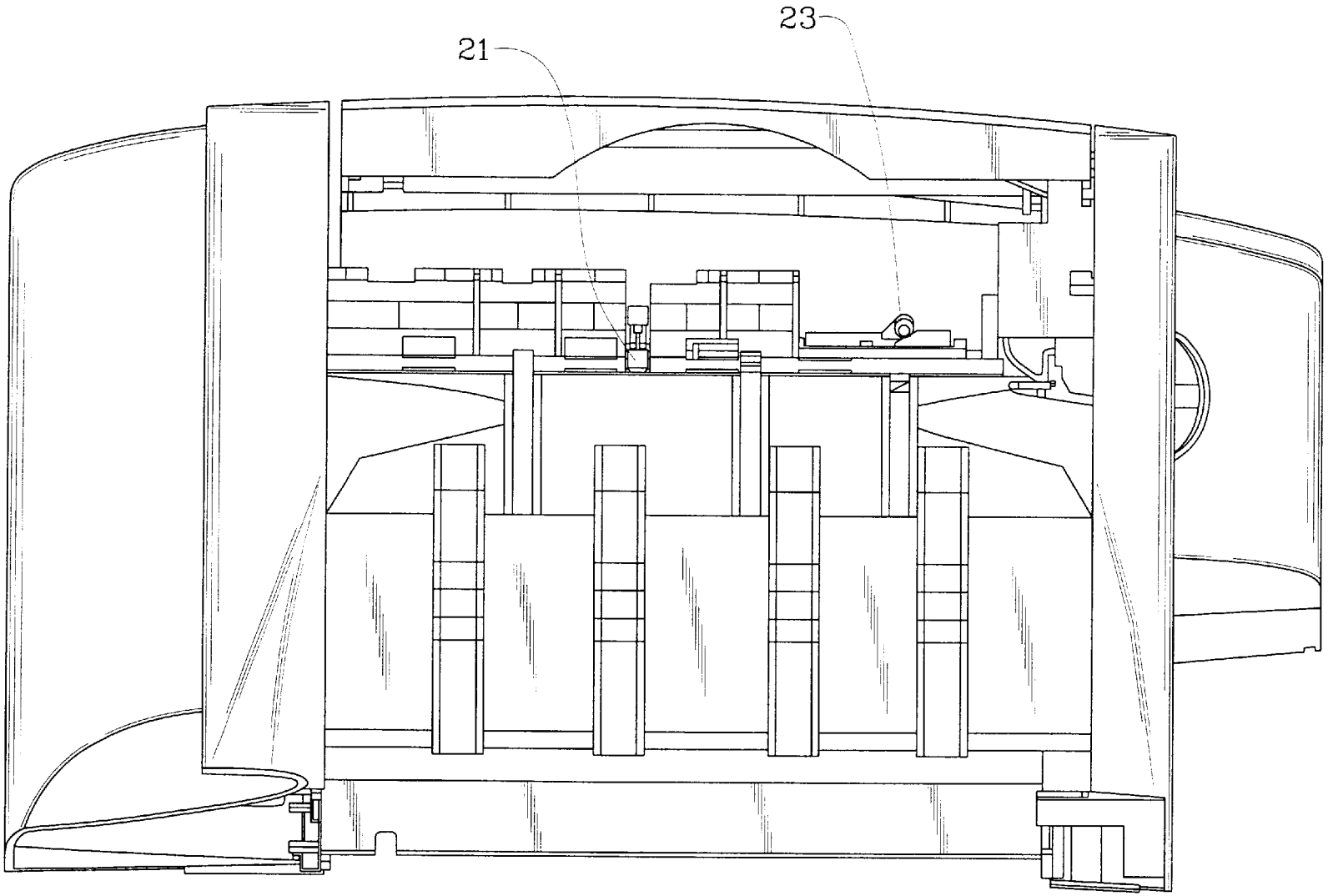
FIG. 4 illustrates the first finger when in contact with a sheet on the tray.

Referring to FIG. 3, when a sheet falls on tray 5, it is then moved inward against a registration surface by frictional contact with left finger 21. The sheet is then moved rightward by right finger 23. During the fall of the sheet onto tray 5, fingers 21 and 23 are rotated out from being over tray 5, as shown in FIG. 3. After a sheet reaches tray 5, left finger 21 rotates out over tray 5 and downward to contact the sheet, as shown in FIG. 4. Right finger 23 remains withdrawn.

Since the mechanical details to operate fingers 21 and 23 may take many generally standard forms, the specific implementation shown is considered incidental to this invention. The further significance of fingers 21 and 23 to this invention is that they contact sheets close to their final registration position, which minimizes buckling of the sheets as they are moved against that registration surface.

Figure 5:
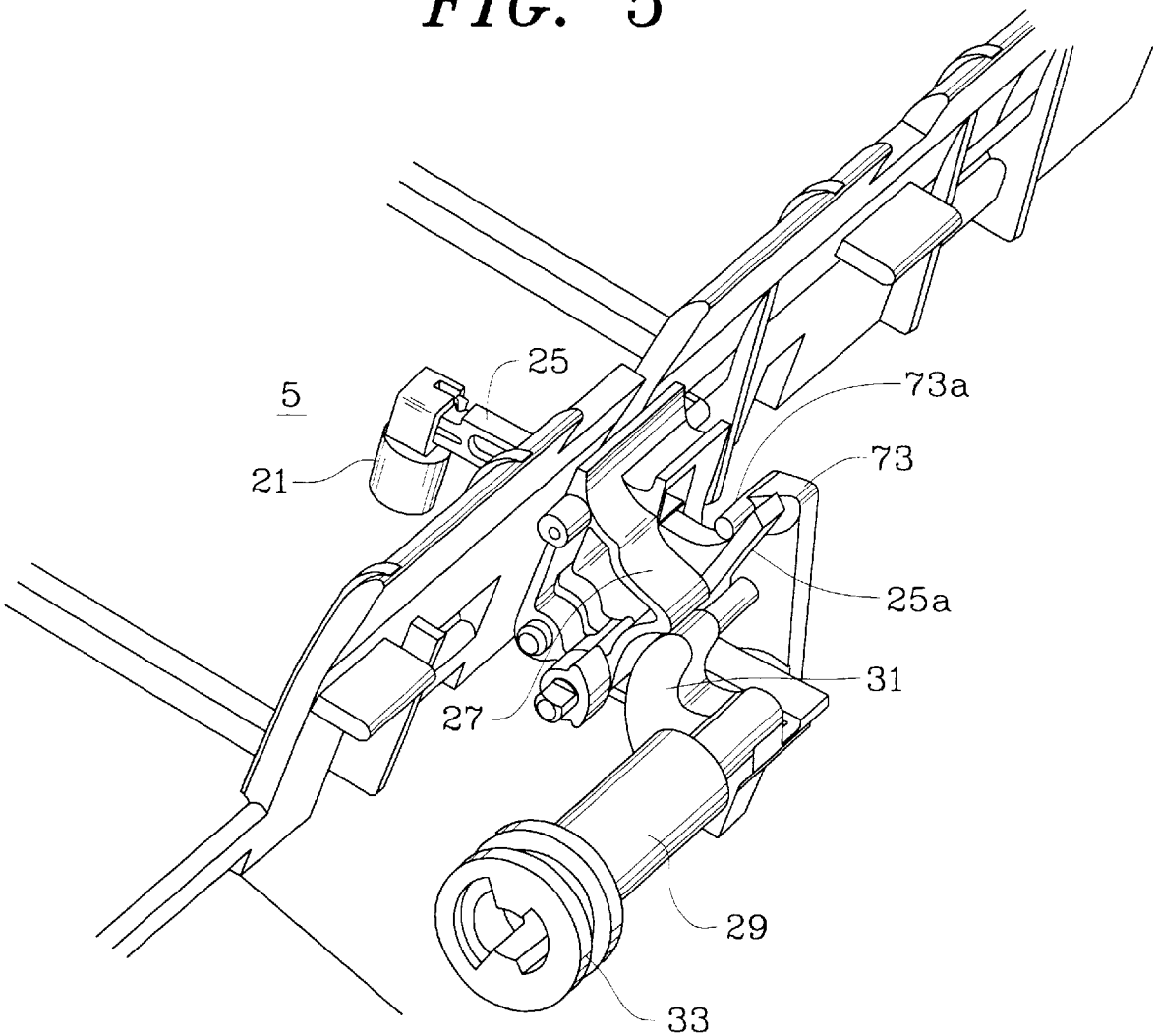
FIG. 5 illustrates generally a mechanism to move the first finger.

So as to illustrate generally an embodiment for purposes of illustration, mechanical elements controlling finger 21 are shown in FIG. 5. Finger 21 is mounted on a retractable arm 25. Retractable arm 25 is biased rearward by a torsion spring (75 in FIG. 16 operating on arm 73). Finger 21 and arm 25 are pivotally mounted on cam-follower bracket 27. Cam-follower bracket 27 is biased to pivot finger 21 and arm 25 upward by coil springs (not shown).

Shaft 29 carries cam 31. The opposite end of shaft 29 carries lost-motion coupler 33. Lost-motion coupler 33 receives a single revolution of torque as will be described. Initially in the revolution, cam 31 engages bracket 27 to pivot bracket 27 forward, thereby pivoting finger 21 forward. Also, initially cam 31 engages extension 25*a* of retractable arm 25, pushing finger 21 outward. Subsequently in the cycle finger 21 has engaged the sheet on tray 5 while cam 31 has moved to allow extension 25*a* to move rearward under bias of a torsion spring (75 in FIG. 16), thereby causing finger 21 to move rearward while engaging the sheet on tray 5. After that movement cam 31 disengages from bracket 27, permitting the coil springs (not shown) to vigorously rotate bracket 27, and therefore finger 21 upward to the position shown in FIG. 3.

Figure 6:
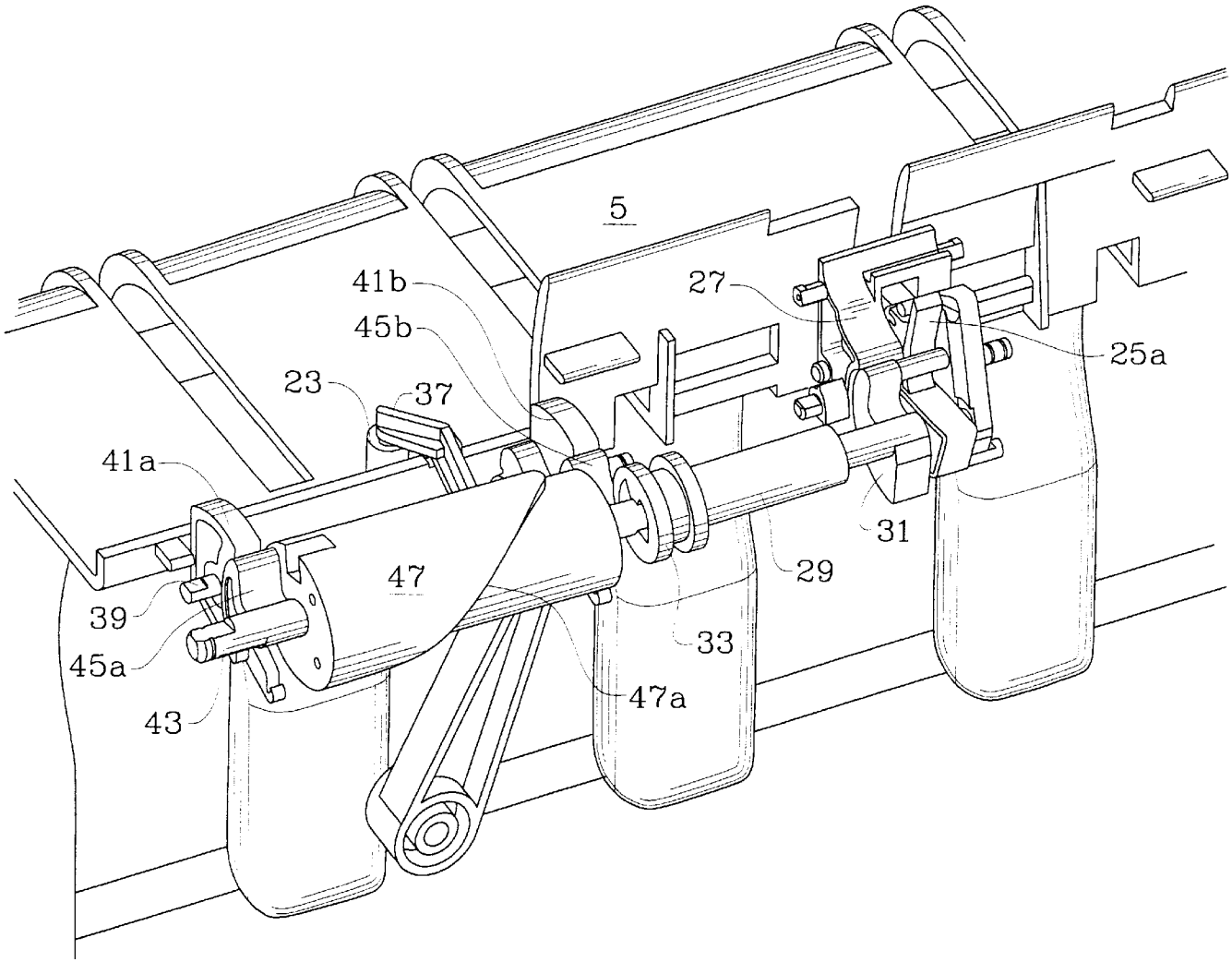
FIG. 6 illustrates generally a mechanism to move the other finger.
Figure 7:
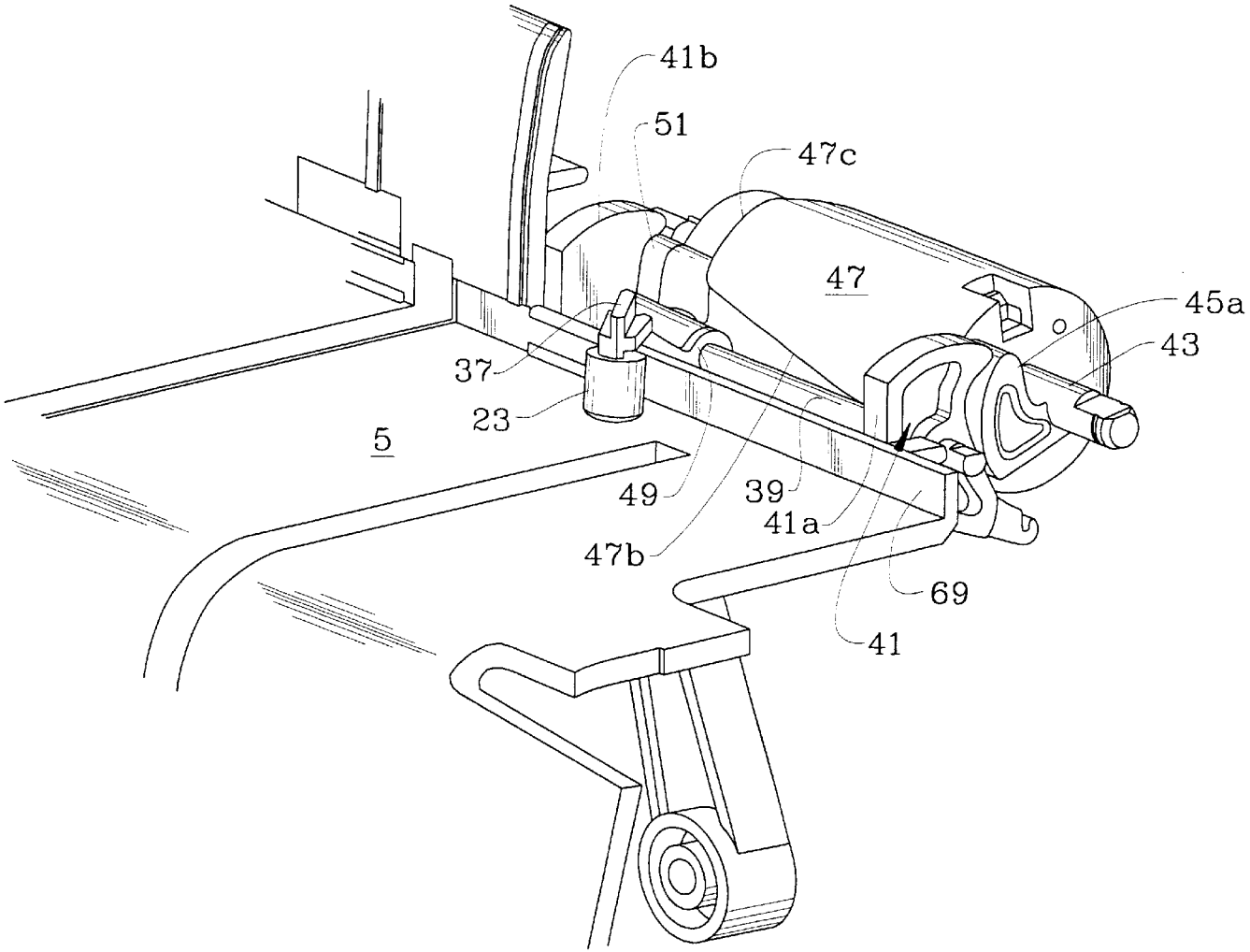
FIG. 7 further illustrates a mechanism to move the other finger.

Further illustrating generally an embodiment for purposes of illustration, mechanical elements controlling finger 23 are shown in FIG. 6 and FIG. 7. Finger 23 is mounted on an arm 37. Arm 37 is supported by shaft 39 while being free to rotate and move laterally on shaft 39. Also rotatably mounted on shaft 39 is cam follower 41.

Figure 18:
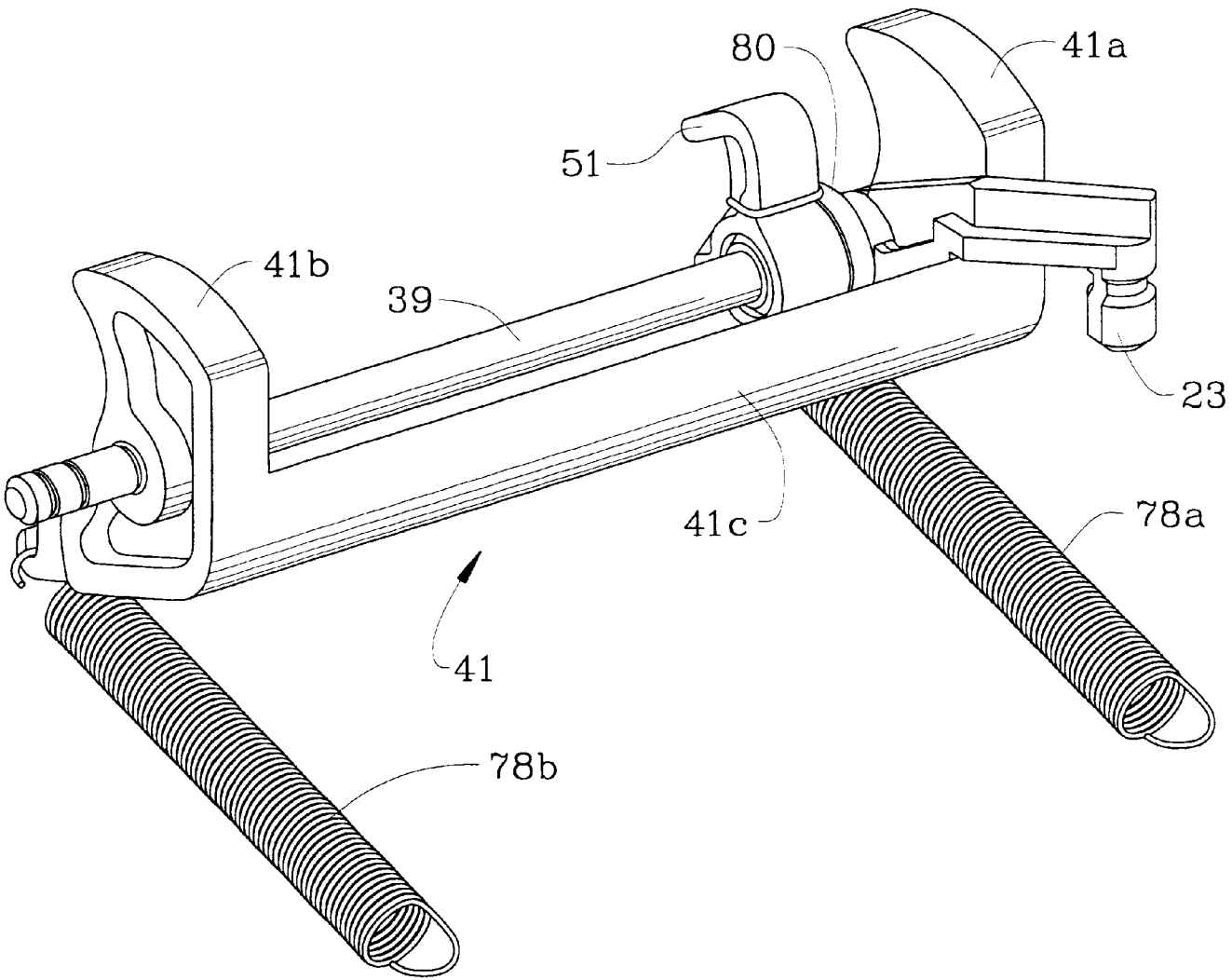
FIG. 18 illustrates the mounting of the other frictional finger from the front.

Cam follower 41 has a right cam surface 41*a* and a left cam surface 41*b.* They are connected to a lift bar 41*c* (FIG. 18, obscured in FIG. 7). Lift bar 41*c* moves finger 23 upward as will be explained with respect to FIG. 18.

Located to the rear of shaft 39 is shaft 43 carrying narrow cam 45*a,* which follower 41*a* contacts; narrow cam 45*b,* which follower 41*b* contacts; and elongated cam 47. Elongated cam 47 has first laterally extending cam surface 47*a* (FIG. 6).

Referring to FIG. 7, elongated cam 47 has a second laterally extending cam surface 47*b.* Arm 37 is integral with slider 49, which surrounds shaft 39 for lateral movement of arm 37 and therefore of finger 23. Similarly, arm 37 is integral with follower 51, shown in FIG. 7 held laterally by surface 47*c* of elongated cam 47, surface 47*c* being circumferential around cam 47.

Figure 17:
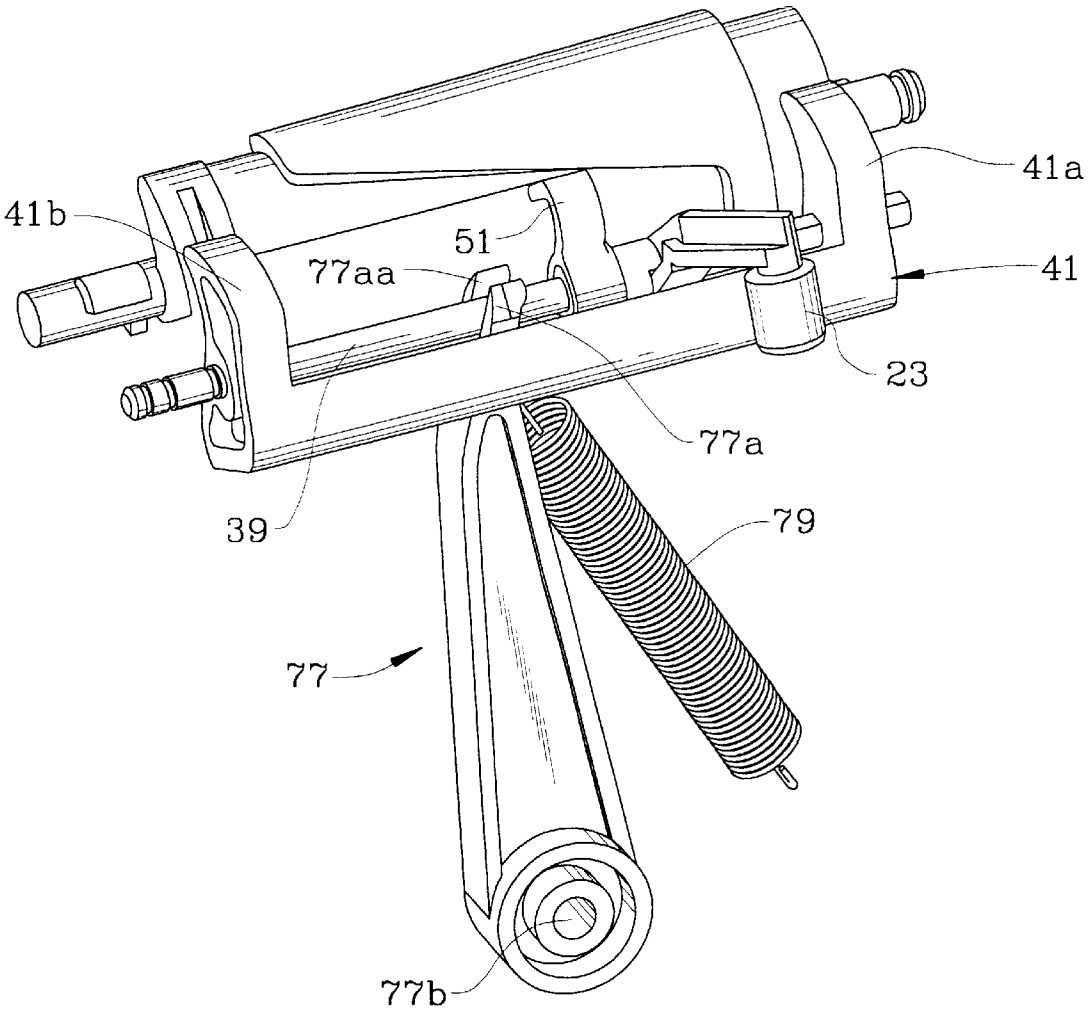
FIG. 17 illustrates the mounting of the other friction finger from the front.

During operation, after the movement of finger 21 (FIG. 5) controlled by cam 31 as described, shaft 43 continues to turn to complete one revolution. Cams 45*a* and 45*b* (FIG. 6) rotate follower 41 (FIG. 7), which allows the rotation of slider 49 and therefore rotates arm 37, which brings finger 23 in contact with the sheet on table 5. Continued movement of shaft 43 results in follower 51 clearing surface 47*c* and facing surface 47*b.* The assembly of follower 51, slider 49 and arm 37 is biased toward follower 41 by a coil spring 79 (FIG. 17). Therefore, finger 23 moves rightwardly as follower 51 follows cam surface 47*b* as shaft 43 rotates to bring finger 23 to its rightward position. During subsequent rotation follower 51 is pushed leftward by elongated surface 47*a* (FIG. 6) until it is once again held against surface 47*c* (FIG. 7).

Final positioning is conducted employing a curl control device. This device is the subject of U.S. patent application Ser. No. 09/611,126 filed Jul. 6, 2000, and assigned to the assignee to which this application is assigned.

Paper exiting a printer tends to curl. This is particularly true for paper exiting an electrophotographic printer having a fusing process to fix toner, as is widely practiced. The wetter the paper is before printing, the more curl occurs. In order to staple a stack of such paper, the stack must be loaded into the throat of a stapler, which becomes difficult when the paper is curled.

To flatten the curl in the vicinity of the throat and press the paper into a uniform stack, an eccentric guide 53 and clamp arm 55 are employed as shown particularly in FIGS. 8 through 12.

Figure 8:
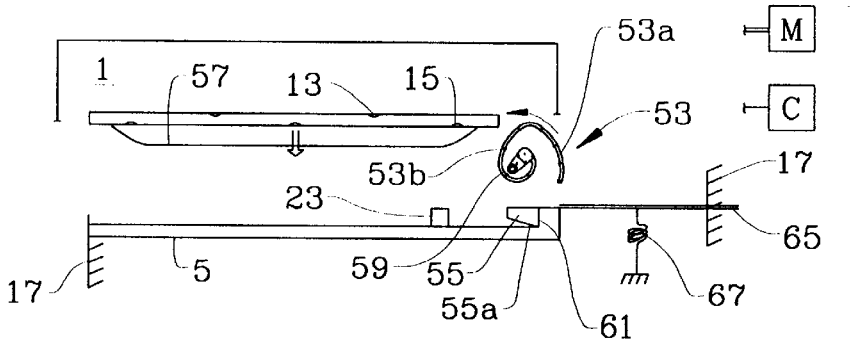
FIG. 8 illustrates the finisher from the front and the apparatus to control curl, showing paper dropping out from the printer.

With reference to FIG. 8, output from printer 1 is suggested illustratively by showing corrugation roller shafts 13 and 15 that emit printed sheets. A sheet of paper or other media 57 is shown having just been moved out from shafts 13, 15.

Paper 57 is shown in its normal action of falling under force of gravity (after bails 11*a*, 11*b* have dropped) to rest above generally flat tray 5. Shown in FIG. 8 to the right of center is finger 23, which is moved to the right in FIG. 8 to move sheet 57. Shown in FIG. 9 is finger 21, which is moved to the left in FIG. 9 to move sheet 57 rearward.

Sheet 57 is shown curled on each side as is typical. Eccentric guide 53 at the right in FIG. 8, is mounted for rotation on shaft 59, having a high section 53*a* and a low section 53*b*, with the low section 53*b* facing paper 57 in FIG. 8. Also shown are clamp arm 55, and a side reference wall 61 (see also FIG. 13). A stapler 63, shown illustratively in FIG. 9, is omitted from FIGS. 2–5, 8 and 10–12 for clarity.

Clamp arm 55 is pivoted on pin to a frame 17, and lightly biased downward by spring 67 or other resilient element. Table 5 is similarly supported on frame 17. Also shown illustratively in FIG. 8 is a motor M and electronic data processor C (commonly termed a computer). Overall control is by computer C, as is standard for electronic controls. Motor M is linked by transmission members (not shown in FIG. 8) to rotate eccentric guide 53 around shaft 59. Motor M may be similarly linked to move fingers 21 and 23. When fingers 21 and 23 and guide 53 are moved from the same source, such as motor M, their movement may be directly coordinated. As is also standard, timing controls in the software program of computer C can dictate the movement of the various parts of this invention if they have separate drive sources.

Figure 9:
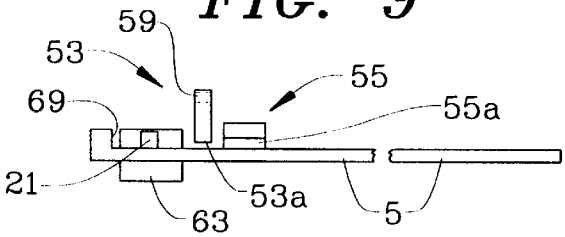
FIG. 9 is a side view like FIG. 8 from the left showing the eccentric curl guide and the front of the clamp, as well as a stapler shown illustratively.

With reference to FIG. 9 eccentric guide 53 is shown with high section 53*a* nearest table 5. No sheet 57 is shown so as not to obstruct the view of the element shown. The face of high section 53*a* may be smooth, as it should not obstruct the movement of sheet 57 into clamp arm 55 and against reference wall 61 (FIG. 8). Reference wall 69 (see also FIG. 7) is perpendicular to reference wall 61. The high section 53*a* of guide 53 is spaced from table 5 at its lowest point as shown to leave room for a stack of sheets 57 to be formed.

As shown in FIG. 8, lower front side 55*a* of clamp arm 55 has an acute angle so as to receive sheet 57 at an angle which directs sheet 57 downward to push under clamp arm 55 by overcoming the force of resilient member 67. Angled side 55*a* of arm 55 faces away from reference wall 61 and toward finger 23. Each sheet 57 is moved under clamp arm 55 until stopped against reference wall 61.

In operation, each sheet 57 exits rollers 13 and 15 as shown in FIG. 8 with the low section 53*b* of guide 53 facing the paper and therefore guide 53 is not obstructing sheet 57 from falling onto table 5.

Finger 21 (FIG. 9) then moves to push sheet 57 rearward (leftward in FIG. 9) toward reference wall 69 until sheet 57 is in full contact with reference wall 69.

Figure 10:
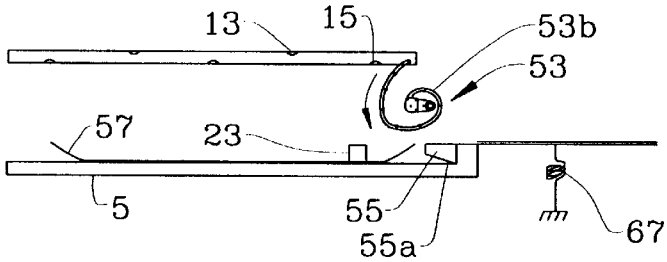
FIG. 10 illustrates operation during a cycle.
Figure 11:
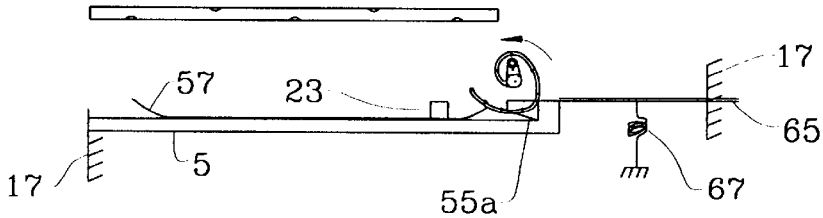
FIG. 11 illustrates operation further in a cycle.

As shown in FIG. 10 guide 53 has rotated so that high section 53*a* is over sheet 57 and moving downward toward it. Finger 23 then moves toward guide 53, thereby moving sheet 57 toward guide 53. This action continues, and as high section 53*a* moves closer to table 5, it encounters the end of sheet 57 and begins to press it downward, as shown in FIG. 11.

Figure 12:
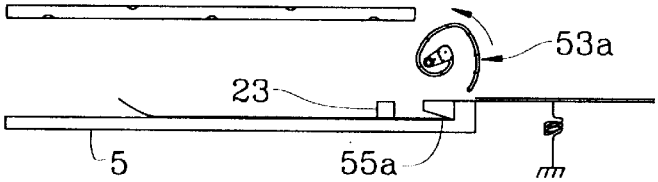
FIG. 12 further illustrates operation in a cycle.

This action continues until high section 53*a* is at its lowest level and sheet 57 has been moved under clamp arm 55 as shown in FIG. 12. High section 53*a* has overcome any curl in sheet 57 to assure that sheet 57 encounters lower front side 55*a* of clamp arm 55 to be guided under clamp arm 55. Clamp arm 55 is flexed upward under the moving force of sheet 57 to receive sheet 57. Finger 23 continues moving sheet 57 until it is moved in full contact with reference wall 61. Clamp arm 55 is biased downward by resilient member 67, which has a force sufficient to resist curl forces in sheets 57 under clamp arm 55. Sheet 57 is thereby stacked regularly above any previous sheets 57 to which the foregoing operation has been conducted. This is all done under the control of computer C that may use standard electronic control as is now common. When the end of a given set is defined in the software of computer C, computer C causes operation of stapler 63 (FIG. 9) to thereby complete finishing of one job. The stapled set may be removed by hand or mechanically as by grasping mechanically or pushed forward by set pushers 19*a*, 19*b*, 19*c* (FIG. 2) into output tray 7.

The stapled stack is then pushed onto tray 7 by pusher 19*a*, 19*b*, 19*c* and the next sheet can be moved as described to start a second set to be stapled and then pushed onto tray 7.

It will be apparent that sheet 57 may be moved to reference surface 69 after movement of finger 23. However, that movement would be against friction from clamp arm 55. Movement against surface 69 and then against surface 61 is therefore that implemented.

The system shown would accommodate a finite stack height limited by high section 53*a* of guide 53 no longer being above sheets 57. It will be apparent, however, that guide 53 and clamp arm 55 could be mounted to move upward as a unit so as to move upward an amount corresponding to the height of stacks of sheets 57.

Guide 53 could be a flexible solid, more or less, having the outer outline forming the high section and low section. The twisted band employed is so flexible as to prevent damaging stops should a hard object be dropped under guide 53.

Figure 13:
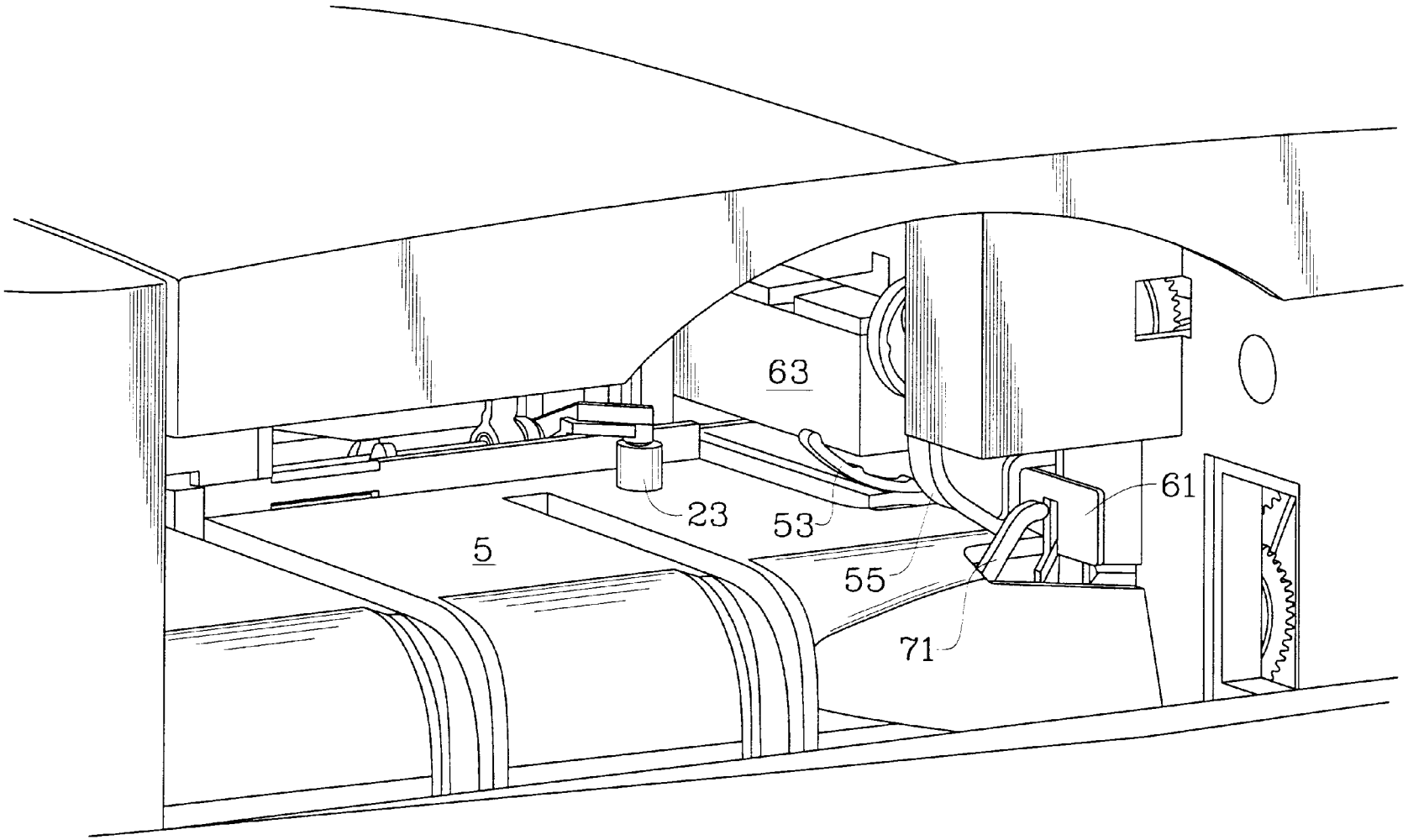
FIG. 13 illustrates the elements of FIGS. 8 and 9 in more detail.

With respect to the other drawings, reference surface 69 is best seen in FIG. 7, while reference surface 61 appears in FIG. 13, as well as clamp arm 55, part of guide 53 and stapler 63. Arm 71 is merely a paper presence switch.

Figure 14:
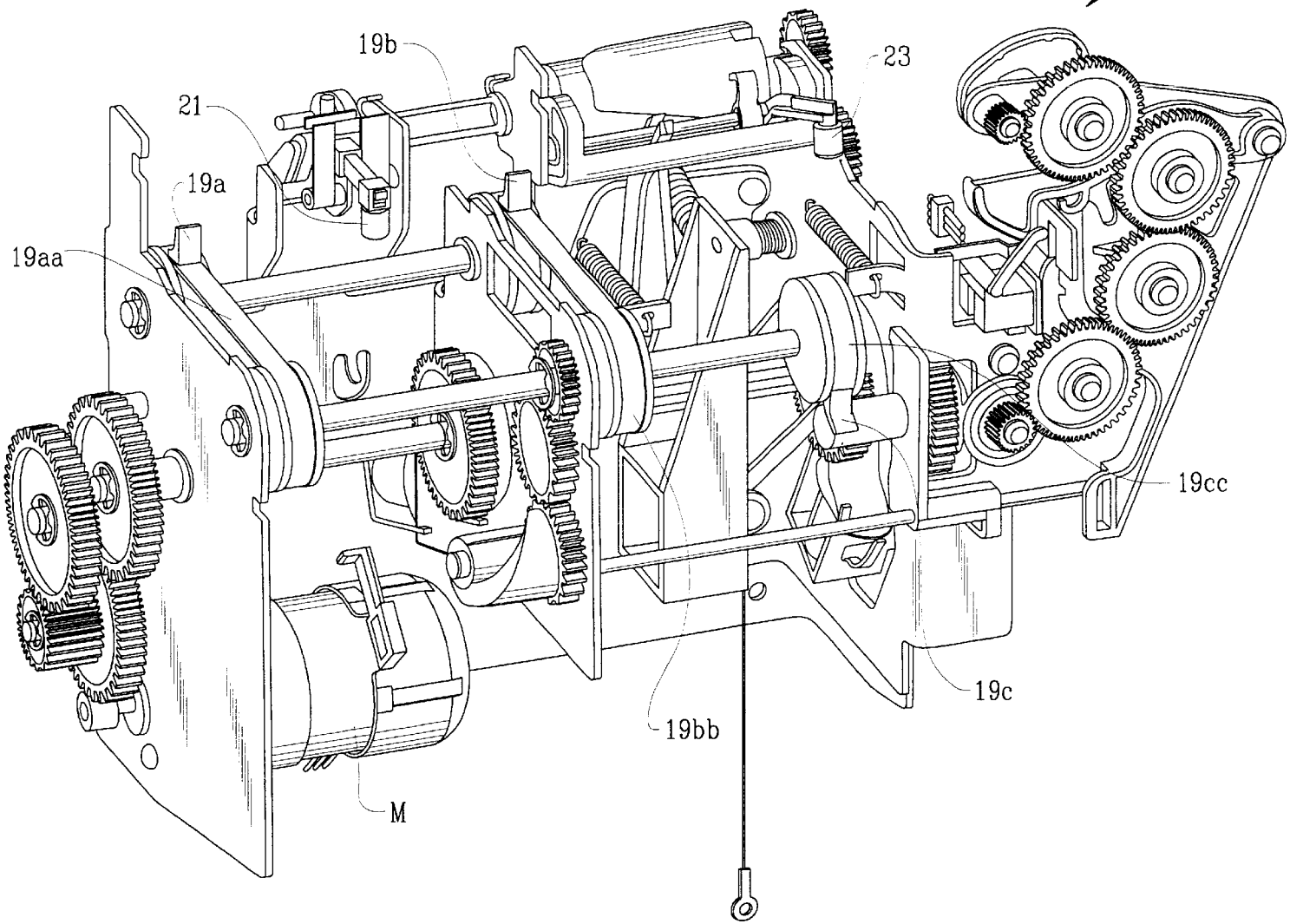
FIG. 14 illustrates the motor and gear train of the embodiment.

While the details of the gear train are not the subject of the patent coverage of this application, as an illustration of an embodiment as disclosed, FIG. 14 illustrates the gear train. The motor M is the single source of movement for the fingers 21 and 23 as well as the bands 19*aa*, 19*bb*, 19*cc* carrying set pushers 19*a*, 19*b*, 19*c*. Similarly, the single motor M, through the gear train drives eccentric guide 53. Motor M and much of the gear train is located under table 5.

Figure 15:
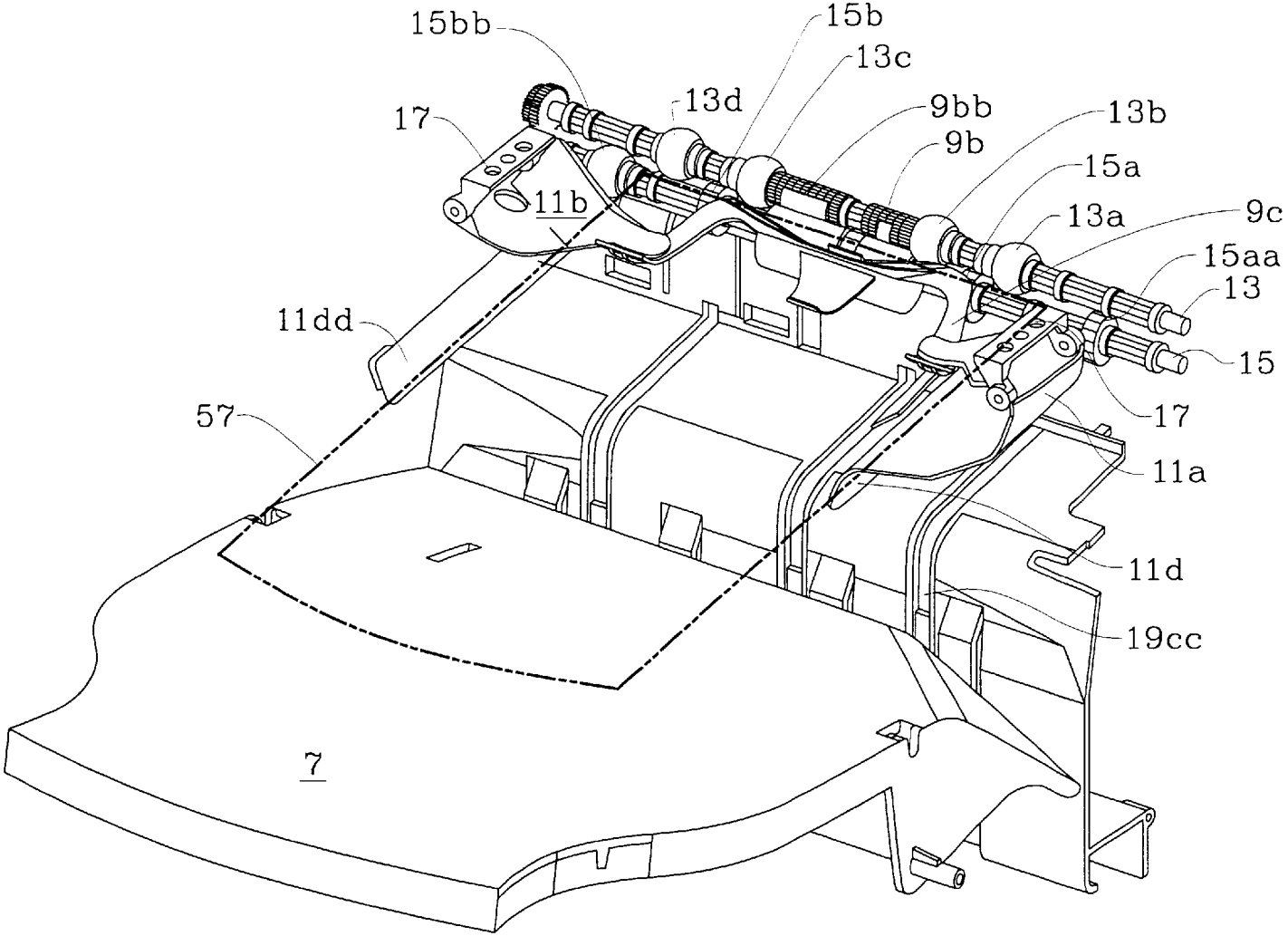
FIG. 15 illustrates a sheet with bails up.

FIG. 15 is a view identical to FIG. 2 with a sheet 57 of standard letter paper near the end of is outward movement, thereby moving bails 11*a* and 11*b* upward as described, to support and corrugate media as previously described. For some types of media, the outward end of sheet 57 intercepts tray 7 (or stack of stapled sheets on tray 7) before bails 11*a* and 11*b* release. Where there are sheets on tray 7, the outward end of sheet 57 in FIG. 15 would be supported on such sheets. As discussed, tray 7 is spring mounted and drops proportionately to the weight of sheet held on tray 7.

A feature of operation of fingers 21 and 23 is that their ends are of significant friction material, but they normally do not slide over the sheets 57. Instead, fingers 21 and 23 are resilient mounted toward reference walls 69 and 61 respectively with resilient forces insufficient to slide over the sheets. Accordingly, since the lateral movement of fingers 21 and 23 stop when the sheet 57 abuts the respective reference surface 69 and 61, the tendency to buckle sheets 57 is minimized.

Figure 16:
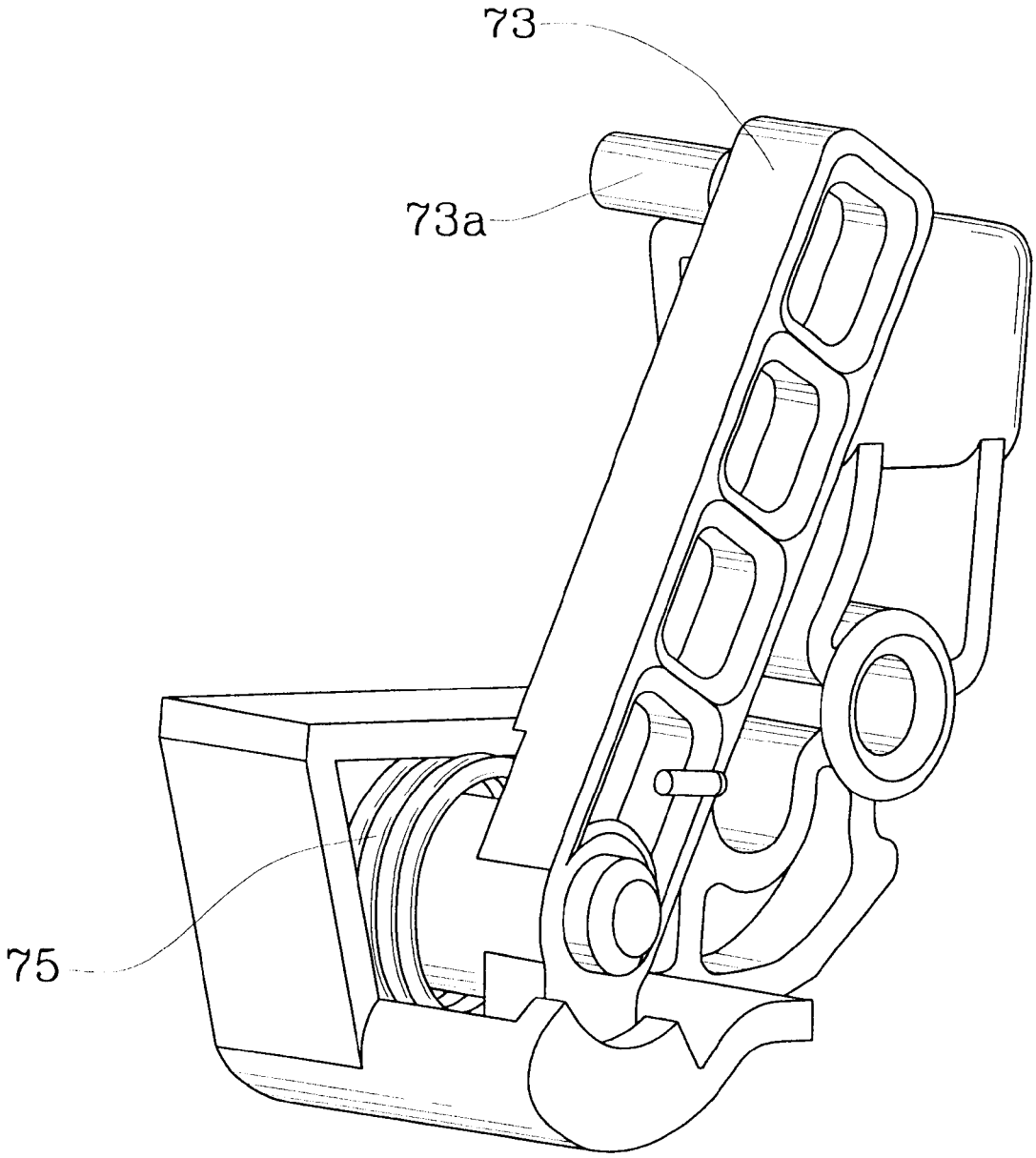
FIG. 16 illustrates a pivoted arm which controls a friction finger.

The elements resiliently mounting arm 25 are shown in FIG. 16. Extension 25*a* of arm 25 (FIG. 5), abuts extension 73*a* (FIG. 16) of pivoted arm 73. A torsion spring 75 biases arm 73 backward with respect to tray 5. As just discussed, spring 75 has sufficient resilience to drag sheets back until they encounter reference wall 69, but insufficient force to move finger 21 after the sheet encounters reference wall 69.

Similarly, FIG. 17 illustrates the lateral resilient mounting of finger 23. As discussed with respect to FIG. 7, follower 51 and finger 23 are guided by and are free to move along shaft 39. Movement toward reference wall 61 (FIG. 13) is by pushing by arm 77, having two extensions 77*a* and 77*aa* which bridge shaft 39. Arm 77 pivots around pivot shaft 77*b*, which is mounted on a stud (not shown) in the frame. Arm 77 is biased to pivot toward the right as shown in FIG. 17 by coil spring 79, which is also attached in the frame 17 (not shown in FIG. 17). (For purposes of illustration, extensions 77*a* and 77*aa* are shown separated from follower 51. However, in use extensions 77*a* and 77*aa* always contact follower 51.) As discussed, spring 79 has sufficient resilience to drag sheets until they encounter reference wall 61, but insufficient force to move finger 23 after the sheet encounters reference wall 61.

FIG. 18 is a front view with respect to FIG. 17. The downward pressure of finger 23 is produced by a torsion spring 80 (shown illustratively) mounted on shaft 39. Lift bar 41*c* raises finger 23 when followers 41*a* and 41*b* rotate upward by the force of coil springs 78*a* and 78*b*.

A further feature of operation of this finisher 3 is a positive clamp 81, which operates after sheet 57 is finally positioned by fingers 21 and 23. This is shown in perspective in FIG. 19 and in the bottom view in FIG. 20. Although clamp 81 is physically integrated with the curl control mechanism, that is not essential but does make possible the efficient use of the gear train as shown in FIG. 14. Positive clamp 81 further prevents sheets located on reference surfaces 61 and 69 from moving from them using internal energy, such as from buckling.

Gear 83 is integral with cam 85. Gear 83 is driven by the gear train as shown in FIG. 14 and therefore is operative in direct, timed relationship with fingers 21 and 23. Positive clamp 81 is carried on follower arm 87, which is pivoted (not shown) to the frame under and rightward of cam 85. Follower arm 87 is biased downward by a spring 89 (shown illustratively). During each cycle of operation, immediately after each sheet 57 is forced under against reference wall 61 (not shown in FIG. 18) and under clamp arm 55, cam 85 reaches a position away from follower surface 87*a* permitting spring 89 to pull clamp 81 down on to paper. Since spring 89 is selected to be so strong as to hold sheets 57 firmly in place, clamp 81 positively holds sheet 57 in place. As the next sheet is received, cam 85 has acted on follower surface 87*a* to pivot cam follower 87, thereby raising clamp 81.

Figure 19:
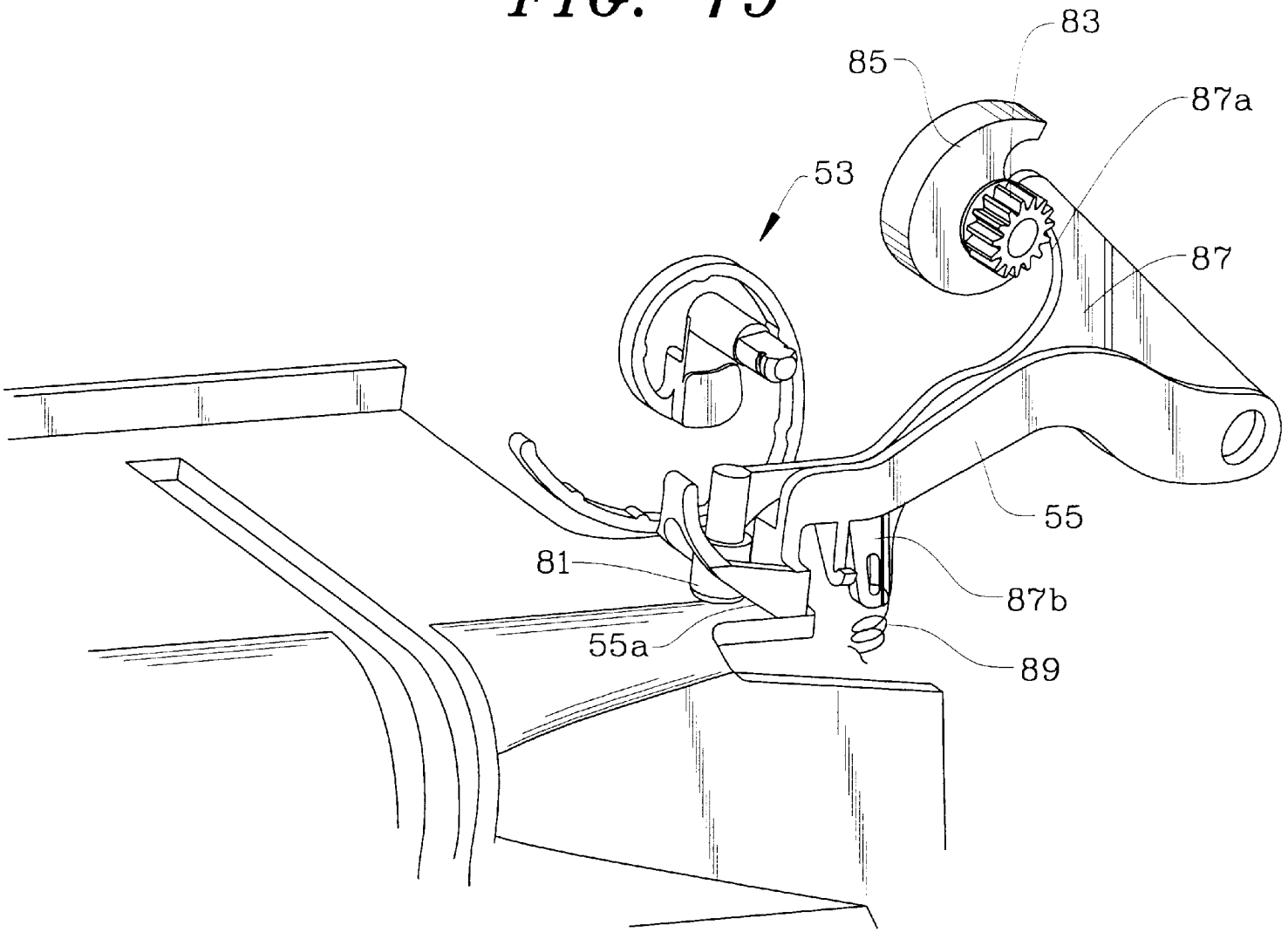
FIG. 19 illustrates a positive clamp.
Figure 20:
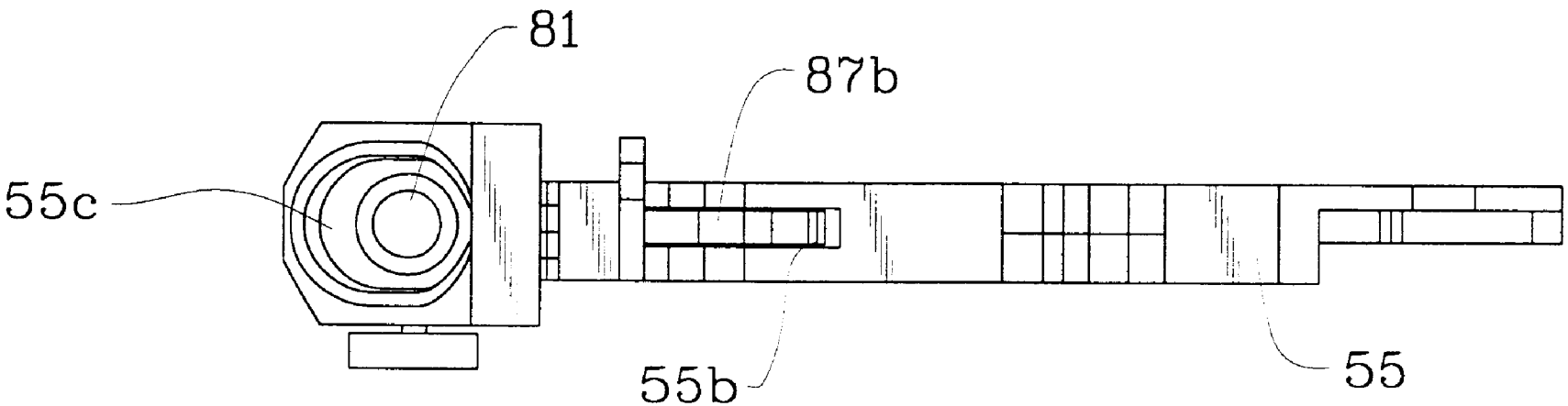
FIG. 20 is a bottom view of the clamp area of FIG. 19.

As shown in FIG. 20, extension 87*b* of follower arm 87 passes through a slot 55*b* in clamp arm 55. Similarly, clamp 81 passes through a central hole 55*c* in clamp arm 55. As shown in FIG. 19, spring 89 is attached to extension 87*b*. As mentioned, although this structure is compact and efficient, the positive clamp could be located at any location generally near one of the reference walls 61 or 69.

Sheets 57 float downward when released and some ultimately locate with edge at rear reference wall 69 or at the inward edge of stapler 63, which is located slightly inward of the side reference wall 61. The farthest point of the center of finger 21 is 13.7 mm from rear reference wall 69. The farthest point of the center of finger 23 is 49.35 mm from the right inward edge of stapler 63. Both distances are less than about 2 inches. Such distances between the finger and the correspondence reference wall (such as finger 23 and wall 61) greater than 2 inches tend to result in undesirable buckling of lightweight sheets.

As will be apparent from the foregoing, details of design and implementation can vary greatly.

What is claimed is:

1. A finisher to stack sheets exiting a printer comprising:

a tray having a top surface positioned to receive printed sheets on said top surface, sheet movement apparatus to move sheets from said printer laterally over said top surface, a rotatable abutment member which a sheet encounters when moved by said sheet movement apparatus to cause rotation of said abutment member, said abutment member being linked to actuator members on opposite sides of said abutment member, rotation of said abutment member causing rotation of said actuator members, pivoted bails on opposite sides of said abutment member, each having an actuation member, said actuator members on each side when rotated engaging said actuation member of said bail of the respective side to cause rotation of said bails, said bails having an elongated member positioned to support a sheet during movement of the sheet by said sheet movement apparatus, at least one of said bails having a second elongated member spaced inward of a first elongated member of said at least one bail to support sheets narrower than sheets supported by said first elongated member, and said bails and said abutment member rotating under gravity when said sheet leaves said sheet movement apparatus, said sheet then being moved down under gravity toward said top surface.

2. The finisher as in claim 1 in which said elongated members of said bails, have a generally flat surfacing facing a sheet during said support of a sheet.

3. The finisher as in claim 1 in which said sheet movement apparatus includes opposing corrugation rollers to corrugate sheets to increase their longitudinal beam strength as said sheets exit the printer.

4. The finisher as in claim 3 in which said elongated members of said bails have a generally flat surfacing facing a sheet during said support of a sheet.

5. The finisher as in claim 1 in which said abutment member and said actuator member are integral.

6. The finisher as in claim 5 in which said elongated members of said bails have a generally flat surfacing facing a sheet during said support of a sheet.

7. The finisher as in claim 5 in which said sheet movement apparatus includes opposing corrugation rollers to corrugate sheets to increase their longitudinal beam strength as said sheets exit the printer.

8. The finisher as in claim 7 in which said elongated members of said bail have a generally flat surfacing facing a sheet during said support of a sheet.

9. A finisher to stack sheets exiting a printer comprising:

a tray having a top surface positioned to receive printed sheets on said top surface, sheet movement apparatus to move sheets from said printer laterally over said top surface, a rotatable abutment member which a sheet encounters at one part of said abutment member when moved by said sheet movement apparatus to cause rotation of said abutment member, the said part encountered rotating over said tray and said sheet being between said part encountered and said tray, said abutment member being linked to actuator members on opposite sides of said abutment member, rotation of said abutment member causing rotation of said actuator members, pivoted bails on opposite sides of said abutment member, each having an actuation member, said actuator members on each side when rotated engaging said actuation member of said bail of the respective side to cause rotation of said bails, said bails having an elongated member positioned to support a sheet during movement of the sheet by said sheet movement apparatus, and said bails and said abutment member rotating under gravity when said sheet leaves said sheet movement apparatus, said sheet then being moved down under gravity toward said to surface.

10. The finisher as in claim 9 in which at least one of said bails has a second elongated member spaced inward of a first elongated member of said at least one bail to support sheets narrower than sheets supported by said first elongated member.

11. The finisher as in claim 9 in which said elongated member of said bail has a generally flat surfacing facing a sheet during said support of a sheet.

12. The finisher as in claim 11 in which at least one of said bails has a second elongated member spaced inward of a first elongated member of said at least one bail to support sheets narrower than sheets supported by said first elongated member.

13. The finisher in claim 9 in which said sheet movement apparatus includes opposing corrugation rollers to corrugate sheets to increase their longitudinal beam strength as said sheets exit the printer.

14. The finisher as in claim 13 in which at least one of said bails has a second elongated member spaced inward of a first elongated member of said at least one bail to support sheets narrower than sheets sppported by said first elongated member.

15. The finisher as in claim 13 in which said elongated member of said bail has a generally flat surfacing facing a sheet during said support of a sheet.

16. The finisher as in claim 15 in which at least one of said bails has a second elongated member spaced inward of a first elongated member of said at least one bail to support sheets narrower than sheets supported by said first elongated member.

17. The finisher as in claim 9 which said abutment member and said actuator member are integral.

18. The finisher as in claim 17 in which at least one of said bails has a second elongated member spaced inward of a first elongated member of said at least one bail to support sheets narrower than sheets supported by said first elongated member.

19. The finisher as in claim 17 in which said elongated member of said bail has a generally flat surfacing facing a sheet during said support of a sheet.

20. The finisher as in claim 19 in which at least one of said bails has a second elongated member spaced inward of a first elongated member of said at least one bail to support sheets narrower than sheets supported by said first elongated member.

21. The finisher as in claim 17 in which said sheet movement apparatus includes opposing corrugation rollers to corrugate sheets to increase their longitudinal beam strengths as said sheets exit the printer.

22. The finisher as in claim 21 in which at least one of said bails has a second elongated member spaced inward of a first elongated member of said at least one bail to support sheets narrower than sheets supported by said first elongated member.

23. The finisher as in claim 21 in which said elongated member of said bail has a generally flat surfacing facing a sheet during said support of sheet.

24. The finisher as in claim 23 in which at least one of said bails has a second elongated member spaced inward of a first elongated member of said at least one bail to support sheets narrower than sheet supported by said first elongated member.

* * * * *